United States Patent [19]

Cudini

[11] Patent Number: 4,759,111

[45] Date of Patent: Jul. 26, 1988

[54] METHOD OF FORMING REINFORCED BOX-SELECTION FRAME MEMBERS

[75] Inventor: Ivano G. Cudini, Woodstock, Canada

[73] Assignee: TI Automotive Division of TI Canada Inc., Toronto, Canada

[21] Appl. No.: 90,952

[22] Filed: Aug. 27, 1987

[51] Int. Cl.[4] ..... B23P 17/00

[52] U.S. Cl. ..... 29/523; 29/445; 29/516; 29/155 R; 138/140; 138/172

[58] Field of Search ..... 29/516, 445, 421 R, 29/446, 155 R, 523; 138/140, 172

[56] References Cited

U.S. PATENT DOCUMENTS

| | | | |
|---|---|---|---|
| 610,262 | 9/1898 | Dikeman | 29/516 UX |
| 2,102,325 | 12/1937 | Kylstra | 29/516 UX |
| 2,595,695 | 5/1952 | Packer et al. | 29/445 UX |
| 2,752,179 | 6/1956 | Le Febure | 29/516 UX |
| 2,774,384 | 12/1956 | Wallace | 138/172 X |
| 3,009,484 | 11/1961 | Dollens | 29/516 UX |
| 3,253,326 | 5/1966 | Henry et al. | 29/445 UX |
| 3,550,269 | 12/1970 | Yatabe et al. | 29/516 X |
| 3,863,328 | 2/1975 | Arnty | 29/516 |

*Primary Examiner*—Charlie T. Moon

[57] ABSTRACT

This invention relates to a method of forming hollow, box-section, frame members which include localized reinforcement. The frame members are produced by fitting a sleeve about a tube, deforming the tube and sleeve to avoid the occurrence of frictional drag in a final die, and then expanding the tube and sleeve in a final die to form the hollow, box-section, frame member. The expansion is achieved by application of an internal pressure within the tube.

8 Claims, 2 Drawing Sheets

METHOD OF FORMING REINFORCED BOX-SELECTION FRAME MEMBERS

FIELD OF THE INVENTION

This invention relates to a method of forming hollow, box-section, frame members which include localized reinforcement.

BACKGROUND TO THE INVENTION

Hollow, box-section, frame members are frequently required in many applications. These frame members are normally substantially rectangular in cross-section but have smoothed corners as sharp corners are potential weak spots. Furthermore, in many applications, it is often required that these frame members are curved in their length. The curved region of the frame member is often the weakest area of the frame member. This weakness results from stresses incurred while bending the frame member into its curved shape. However, in many applications, it is required that the frame member is sufficiently strong throughout its length.

The applicant in U.S. Pat. No. 4,567,743, which issued Feb. 4, 1986, describes a method in which a tubular work piece or blank may be formed into a hollow, box-section, frame member. In this method, a tubular blank is first bent into a required curved shape. Then, the curved blank is placed in a preforming die to deform the sidewalls of the blank. The sidewalls are then inwardly recessed and concavely curved in areas corresponding to the areas that will form proposed planar sidewalls in the final frame member. The circumference of the deformed blank is desirably no less than about 95% of the circumference of the final product. This allows the deformed blank to be placed in a final die, which has a cavity corresponding to the desired cross-sectional shape of the final frame member, and the die to be closed without pinching the wall of the blank. The blank is then expanded by an internal fluid pressure which exceeds the yield limit of its sidewall. The sidewall thus expands outwardly to conform to the interior of the final die cavity. The method thus provides a convenient method of forming hollow, box-section, frame members.

The applicant, in a U.S. application entitled "Method of Forming Box-like Frame Members", executed on Apr. 29, 1987, discloses an improvement to this basic method. As noted above, the preforming step in the original method is required to prevent the incidence of pinching of the blank within the final die. This pinching results from frictional drag exerted on the blank by the surface of the die cavity. In this latter application, the inventor has found that the frictional drag can be overcome by pressurizing the blank with an internal fluid pressure less than the yield limit of the sidewall of the blank before closing the die sections. As the die sections are closed, the internal pressure causes the sidewall of the blank to bend evenly into the corners of the final die. The sidewall of the blank thus slips over the die cavity surface and avoids the pinching problem. This improvement of the original method avoids the need for a preforming die.

Although the above-described methods solved many of the problems associated with the manufacture of hollow, box-section frame members, the frame members thus produced are not provided with localized reinforcing to prevent weak spots. Accordingly, it is an object of this invention, to provide a method of forming hollow, box-section, frame members which include localized reinforcing.

SUMMARY OF THE INVENTION

This invention provides a method of forming a box-section frame member which has a reinforced area and of which at least an elongate portion is of uniform cross-section having at least two generally opposed and planar sides, the method comprising: providing a tube and a tubular sleeve within which the tube can be received, the tube and sleeve each having a similar continuously smooth, arcuate cross-section; positioning the sleeve about the tube in an area of the tube to be reinforced; deforming the tube and sleeve in a preliminary step in which the sidewalls thereof are deformed inwardly in opposed areas of an elongate portion thereof which generally corresponds in position to the planar sides of the product frame member to provide the tube and sleeve with a continuously smooth arcuate cross-section having generally opposed, inwardly deformed, side walls; enclosing the deformed tube and sleeve within a sectional die having at least two co-operating die sections which define an elongate passage of approximately the same elongate shape as the tube and sleeve and which is throughout of smoothly continuous cross-sectional profile having an at least approximately linearly profiled portion adjacent and parallel to each concavely curved side wall portion of the tube and sleeve, all transverse dimensions of the passage being at least equal to or larger than the deformed tube and sleeve; expanding the blank circumferentially by application of an internal fluid pressure until all exterior surfaces of the tube and sleeve conform to the profile of the die passage and the sleeve is mechanically locked to the tube; and separating the die sections and removing the product reinforced frame member from the die.

BRIEF DESCRIPTION OF THE DRAWINGS

An embodiment of the invention is described, by way of example only, with reference to the following drawings in which.

DETAILED DESCRIPTION OF THE DRAWINGS

Figure 1:
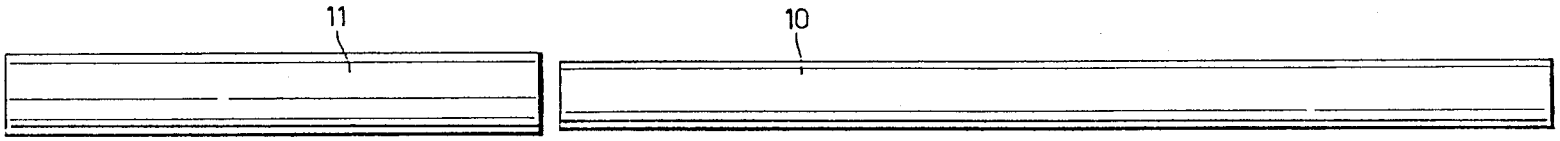
FIG. 1 illustrates a cylindrical tube and a cylindrical sleeve for the tube.
Figure 2:
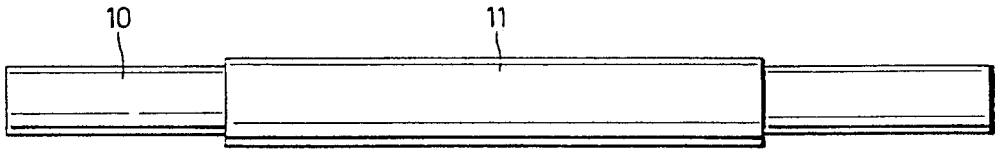
FIG. 2 illustrates the tube and sleeve of FIG. 1 with the sleeve located about a localized portion of the tube.

Referring to FIG. 1, a cylindrical tube 10 and a cylindrical sleeve 11 are illustrated. The inner diameter of the sleeve is such that the cylindrical tube 10 may be slid easily into the sleeve. However, the outer diameter of the cylindrical tube 10 is preferably only just smaller than the inner diameter of the cylindrical sleeve 11. Therefore, the tube 10 need not be expanded greatly before its outer surface matches the outer surface of the sleeve. FIG. 2 illustrates the tube 10 inserted within the sleeve 11.

The assembled sleeve 11 and the tube 10 of FIG. 2 may be bent along their lengths to obtain a desired shape. In the embodiment illustrated in FIG. 3, the tube 10 and the sleeve 11 are bent into approximately an "S" configuration with the bends being in the region of the sleeve. Clearly, the shape of the bend is the shape desired in the product frame member. The bending operation may be performed by using conventional bending procedures, for example mandrel bending, or stretch bending. These bending procedures are generally well known in the art and will not be described in detail in this specification. However, in essence, in mandrel bending an internal mandrel is used while in stretch bending no internal mandrel is used.

In mandrel bending, the minimum radius of the bend that may be imparted to a cylindrical tube is approximately twice the diameter of the tube. Also, the minimum distance between adjacent bent portions is approximately one tube diameter. Furthermore, a cross-sectional area reduction of about 5% is usually achieved. In stretch bending, a minimum bend radius is approximately three times the diameter of the tube, while the minimum distance between adjacent bends will be approximately one-half of the diameter of the tube. Usually, a cross-sectional area reduction of about 15% is achieved.

In this embodiment, it is preferable to use mandrel bending. The sleeve 11 and the tube 10 are bent at the same time and while the sleeve covers the portion of the tube to be bent, in the event that the portion to be reinforced is desired to be curved.

Figure 3:
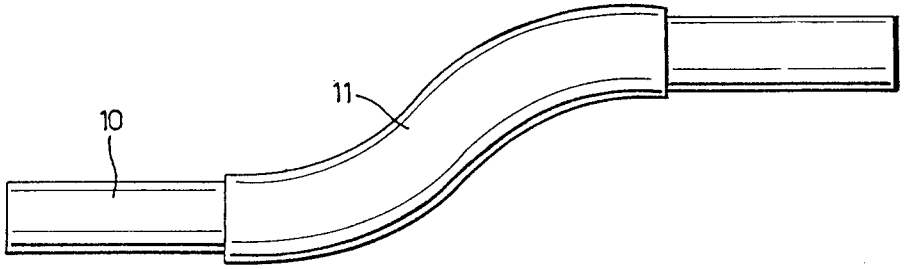
FIG. 3 illustrates the sleeve and tube of FIG. 2 bent along their lengths into a desired curved form.
Figure 4:
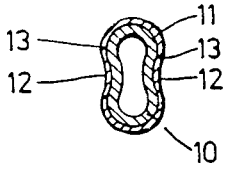
FIG. 4 illustrates, in cross-section, a deformed tube and sleeve.

The bent tube and sleeve of FIG. 3 are then subjected to a preliminary process to prevent pinching thereof in a final die. This may be achieved by preforming or by internally pressurizing the tube. Considering preforming first, a suitable preforming die is well described in U.S. Pat. No. 4,567,743 and will not be described in detail in this specification. In essence, the die consists of two metal halves each having a recess formed into a surface thereof. The recess is in the form of an elongated channel which may extend the length of the half. When the halves are joined together, the recesses complement one another to form an elongated tubular passage. This passage is approximately hourglass shaped in cross-section. When a tube 10 and a sleeve 11 are located within the recess of a first half and the other half is closed on to the first half, the sidewalls of the tube and sleeve are deformed inwardly. A concave recess 12 is thus formed in the sidewalls 13 which correspond to flat or approximately flat faces in the final product frame member. Therefore, the sleeve 11 and the tube 10 are approximately hourglass shaped in cross-section as is clearly illustrated in FIG. 4. The tube and sleeve are subjected to this preforming operation to avoid pinching or the formation of sharp angular deformities when they are subsequently placed in the final die. Furthermore, it is preferable that the tube and sleeve maintain a smoothly continuous and gently rounded cross-sectional profile during all steps in the forming process. It has been found that this inhibits formation of points of stress when expanded in the subsequent final die. This facilitates the production of a box-section frame member with good mechanical strength.

Figure 7:
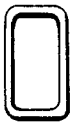
FIG. 7 illustrates, in cross-section, the frame member of FIG. 5.
Figure 5:
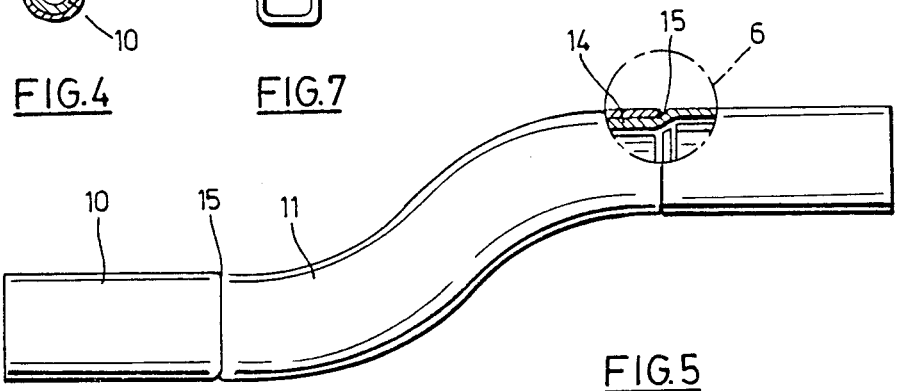
FIG. 5 illustrates the sleeve and tube of FIG. 3 formed into a box-section frame member.

At this stage, the tube and sleeve may be subjected to expansion in the final die. This procedure and the die in which the procedure takes place is well described in U.S. Pat. No. 4,567,743, the disclosure of which is incorporated herein by reference. Briefly, however, the die consists of upper and lower halves each having a recess formed into one side thereof. When the two halves are joined, the recesses complement one another to form an elongated passage of substantially rectangular cross-section. Preferably, the corners of the rectangle are smoothly curved. Clearly, the elongated passage may be curved in its length so as to correspond to the desired curves of the frame member. The ends of the tube located within the passage are then sealed. A liquid hydraulic fluid is then injected through one of the seals to internally pressurize the tube and sleeve. The internal pressure is sufficient to expand the sidewall of the tube, and to expand or to outwardly deform the sidewall of the sleeve, evenly into conformity with the substantially rectangularly-shaped passage. The product frame member has a cross-sectional shape substantially as illustrated in FIG. 7. Clearly, the pressure is sufficient to exceed the yield limit of the sidewall of the tube and, if necessary, of the sleeve. This pressure depends on the thickness of the sidewall of the material being expanded as well as on its nature or composition. However, the pressure may be in the region of 20,000 kPa (3,000 psi). The upper and lower halves of the die are held together with sufficient force to prevent any movement during expansion of the tube. This expansion procedure produces a box-section frame having localized reinforcing to a very high degree of accuracy, uniformity, and repeatability.

Instead of placing the tube and sleeve in a preforming die, the tube may be pre-pressurized by sealing the ends of the tube and injecting liquid hydraulic fluid through one of the seals into the tube. This method is better described in the applicant's co-pending patent application executed on Apr. 29, 1987 entitled Method of Forming Box-Like Frame Members, the disclosure of which is incorporated herein by reference. The internal fluid pressurizes the tube to a pressure below the yield limit of the sidewall of the blank or tube. The pressure is selected so that, on closing of the two halves of the final die, it is sufficient to overcome frictional drag exerted by the die halves on the sleeve and on the tube. It is convenient to lay the tube and sleeve within the recess of one die half, internally pressurize the tube, and then close the other die half on to the first die half. On closing of the die halves, the tube and sleeve are inwardly deformed as their upper and lower sides engage the surfaces of the die recesses. This compression urges the lateral sides of the tube and sleeve laterally outward to a point where a lateral portion of the tube and sleeve engages the sides of the die passage. This engagement occurs almost simultaneously with the closing of the two die halves on to each other. Therefore, pinching of the tube and sleeve between the two die halves does not occur. The internal pressure required to prevent pinching of the tube and sleeve within the die may be readily determined by trial and experiment for given dimensions and configurations. Typically, the pressure will be approximately 2,000 kPa (300 psi). At this stage, the upper and lower sidewalls of the tube and sleeve are deformed inwardly but the tube and sleeve both maintain a continuously smooth arcuate cross-section. The tube and sleeve may then be fully expanded to form a reinforced, box-section frame member as described above. One advantage of this improvement is that only a single die is required for both preforming and final expanding.

After completion of the expansion step, the pressure is released, and the hydraulic fluid is pumped out of the interior of the deformed tube. The upper and lower halves of the die are then separated and the final product is removed from the die.

Figure 6:
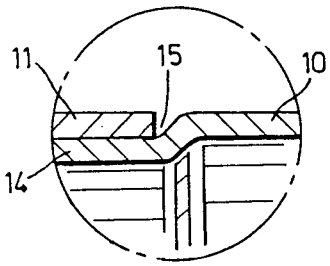
FIG. 6 illustrates an exploded and expanded view of the portion circled at 6 in FIG. 5 showing the mechanical lock between the tube and sleeve.

In the expansion process, the areas 14 of the tube 10 which are surrounded by the sleeve 11 expand radially outwardly to an extent less than those areas of the tube not surrounded by the sleeve. In fact, the difference in extent of expansion is the thickness of the sidewall of the sleeve 11. This is clearly illustrated in FIG. 6. Thus, the box-section frame member produced by this process has a substantially continuous, uniform, outer surface although a small discontinuity 15 occurs in the surface at both ends of the sleeve 11. The tube 10 includes an area 14 which is inwardly offset the thickness of the sleeve over a length approximately the same as the length of the sleeve 11. The offset portion receives and engages the ends of the sleeve 11 and securely locks the sleeve 11 to the tube 10. Therefore, the final product is a locally reinforced box-section frame member which is substantially continuous and uniform in its outer surface and is mechanically sound.

The starting material tube preferably is selected so that the circumference of the final product frame member is at no point along its length more than 5% larger than the circumference of the starting tube. At least with the readily available grades of tubular steel, if the tube is expanded in circumference by more than about 5%, there is a tendency for the material of the sidewall of the tube or sleeve to excessively weaken or to crack. Expansions of the tube circumference of up to about 20% may be performed if the material of the tube is fully annealed, however it is preferable to use metal which has not been pretreated in this manner. The sleeve 11 may be of the same circumference or less than the circumference of the final product. The sleeve 11 may be, for example, of the same material as the tube 10, e.g. SAE 1010 steel, or may be, for example, any material which is sufficiently ductile that it may be expanded to a circumference which is 5–10% larger than its original circumference. The tensile properties of the sleeve material may be, for example, lower or up to 30% greater than that of the tube as the expansion required to lock the sleeve to the tube may be performed on the tube without expansion of the sleeve itself.

It will be appreciated that many modifications may be made to the embodiment without departing from the scope of the invention as set forth in the appended claims. For example, the starting tube and sleeve may be of elliptical cross-section rather than circular cross-section; the tube and sleeve may be bent into a curved shape after they have been formed into a box-section frame member; and the cross-sectional shape of the box-section frame member may be trapezoidal, hexagonal or of any suitable polygon cross-section.

I claim:

1. A method of forming a box-section frame member having a reinforced area and of which at least an elongate portion is of uniform cross-section having at least two generally opposed and planar sides, the method comprising:

(a) providing a tube and a tubular sleeve within which the tube can be received, the tube and sleeve each having a continuously smooth, arcuate cross-section;

(b) positioning the sleeve about the tube in an area of the tube to be reinforced;

(c) deforming the tube and sleeve in a preliminary step in which the side walls of the tube and sleeve are deformed inwardly in opposed areas of an elongate portion thereof which generally corresponds in position to the planar sides of the product frame member to provide the tube and sleeve with a continuously smooth arcuate cross-section having generally opposed, inwardly deformed, side walls;

(d) enclosing the deformed tube and sleeve within a sectional die having at least two co-operating die sections which define an elongate passage of approximately the same elongate shape as the tube and sleeve and which is throughout of smoothly continuous cross-sectional profile having an at least approximately linearly profiled portion adjacent and parallel to each concavely curved side wall portion of the tube and sleeve, all transverse dimensions of the passage being at least equal to or larqer than the deformed tube and sleeve;

(e) expanding the blank circumferentially by application of an internal fluid pressure until all exterior surfaces of the tube and sleeve conform to the profile of the die passage and the sleeve is mechanically locked to the tube; and (f) separating the die sections and removing the product reinforced frame member from the die.

2. A method according to claim 1 in which the preliminary process to deform the tube and sleeve comprises enclosing the tube and sleeve in a preforming die in which the side walls of the tube and sleeve are deformed inwardly to provide the tube and sleeve with a continuously smooth, arcuate, cross-section having generally opposed, inwardly recessed, concavely curved, side walls.

3. A method according to claim 1 in which the preliminary process to deform the tube and sleeve comprises closing the sectional die about the tube and sleeve while applying an internal fluid pressure to the tube at least sufficient to overcome frictional forces exerted on the tube and sleeve by the sectional die on closing, and thereby avoiding expulsion of the walls of the tube and sleeve laterally outward between adjacent mating surfaces of the die, and less than the yield limit of the wall of the tube.

4. A method according to claim 1 in which the tube and sleeve are circular in cross-section and are of approximately uniform cross-section.

5. A method according to claim 1 in which the circumference of the cross-sectional profile of the die passage is at all points along its length less than 5% greater than the circumference of the tube.

6. A method according to claim 1 in which the linearly profiled portion of the die passage is rectangular with rounded corners.

7. A method according to claim 6 in which the deformed tube and sleeve have the concave sidewall portions corresponding to two opposite sides of the rectangular cross-section of the product frame member.

8. A method according to claim 1 which includes the step of bending the tube and sleeve along their lengths after positioning the sleeve about the tube but before deforming the tube and sleeve.

* * * * *